US005270784A

United States Patent [19]

Nakane et al.

[11] Patent Number: 5,270,784

[45] Date of Patent: Dec. 14, 1993

[54] IMAGE FORMING APPARATUS HAVING MEANS FOR MEASURING THE AMOUNT OF DEVELOPING AGENT ON THE IMAGE CARRIER

[75] Inventors: Rintaro Nakane, Yokohama; Jiro Egawa, Yokosuka, both of Japan

[73] Assignee: Kabushiki Kaisha Toshiba, Kawasaki, Japan

[21] Appl. No.: 935,276

[22] Filed: Aug. 29, 1992

[30] Foreign Application Priority Data

Oct. 29, 1991 [JP] Japan ..... 3-282601

[51] Int. Cl.[5] ..... G03G 21/00

[52] U.S. Cl. ..... 355/246; 118/691; 355/215

[58] Field of Search ..... 355/214, 215, 246, 208, 355/203; 118/689, 691; 356/445, 446, 448

[56] References Cited

U.S. PATENT DOCUMENTS

| | | | |
|---|---|---|---|
| 3,936,176 | 2/1976 | Whited | 355/215 X |
| 4,279,498 | 7/1981 | Eda et al. | 355/246 |
| 4,451,135 | 5/1984 | Okumura | 118/691 X |
| 4,550,998 | 11/1985 | Nishikawa | 118/691 X |
| 4,723,150 | 2/1988 | Lutus et al. | 355/215 |
| 4,796,065 | 1/1989 | Kanbayashi | 355/208 |
| 5,059,991 | 10/1991 | Morisawa | 355/215 X |
| 5,067,435 | 11/1991 | Hosaka | 355/208 X |

FOREIGN PATENT DOCUMENTS 3-120570 5/1991 Japan .

*Primary Examiner*—A. T. Grimley
*Assistant Examiner*—William J. Royer
*Attorney, Agent, or Firm*—Foley & Lardner

[57] ABSTRACT

An image forming apparatus includes a measuring for measuring an amount of a toner agent deposited on the image carrier. The measuring device has measuring section facing the image carrier, and a conductive cover plate arranged between the measuring section and the image carrier. The cover plate is applied with a voltage whose polarity is equal to the polarity of the toner so that an electric field is generated between the image carrier and the cover plate. The electric field prevents the toner, dispersed from the image carrier, from reaching the measuring section. The toner may also be kept from adhering to the elements of the measuring section by placing a transparent plate between the image carrier and the measuring device.

4 Claims, 5 Drawing Sheets

IMAGE FORMING APPARATUS HAVING MEANS FOR MEASURING THE AMOUNT OF DEVELOPING AGENT ON THE IMAGE CARRIER

BACKGROUND OF THE INVENTION

1. Field of the Invention

The present invention relates to an image forming apparatus such as a color laser printer and a color digital copying machine.

2. Description of the Related Art

In a conventional image forming apparatus, such, as a copying machine, the characteristics of photo conductive body change under the influence of environmental changes, secular changes, and, the like, and an image density may thus be varied. In other words, the densities of copied images may differ from one another even when the same original is copied. It is important for a multi-tone printer, a digital copying machine, or an analog copying, machine to prevent the image density from varying by stabilizing the image density. Particularly in a color copying machine, a variation in image density affects not only density reproducibility, but also the reproducibility of images. It is therefore essential to stabilize the image density.

In the conventional image forming apparatus, a control tolerance for environmental changes and secular changes is applied to a material for constituting the apparatus itself and a process of forming an image so that the image is stabilized by the maintenance of the apparatus. In this apparatus, however, there is a limitation in the control tolerance of the material and process. Maintenance requires labor and costs, and a cycle in which the image density varies is shorter than the maintenance cycle, wherein a stable image density cannot be obtained only by the maintenance.

To control a variation in image density due to environmental and other changes by a cycle shorter than the maintenance cycle, an image forming apparatus has recently been proposed in which the amount of developing agent which is deposited on an image carrier is measured by a measuring device such as a photosensor, and image density is controlled by the result of the measurement. In this image forming apparatus, the measured amount is compared with a predetermined reference value, and image forming conditions such, as an amount of charges applied to the image carrier, the development bias voltage, the amount of exposure and the density of developer are all controlled in accordance with the compared result. The amount of developing agent deposited on the image carrier is thus made constant, and the image density can always be stabilized.

In the above image forming apparatus, the measuring device is placed near the surface of the image carrier on the downstream side of a developing section with respect to the rotating direction of the image carrier. After development is performed in the developing section by supplying a developing agent to a latent image on the image carrier, the measuring device emits light onto the image carrier and detects light reflected by the surface of the image carrier on which the developer is deposited; therefore an amount of developing agent deposited to the image carrier is measured by the measuring device.

Since, however, the measurement surface of the measuring device faces the image carrier, the developing agent flying away from the image carrier may be attached to the measurement surface of the measuring device. If the developing agent is attached to the measurement surface, the measurement precision of the measuring device is lowered, and developer amount of the developer cannot be correctly measured. Consequently, the image density cannot be correctly controlled or constantly stabilized.

SUMMARY OF THE INVENTION

The present invention has been made in consideration of the above situation and its object is to provide an image forming apparatus capable of measuring an amount of developing agent deposited to an image carrier with high precision and forming an image whose density is always stable.

To attain the above object, there is provided an image forming apparatus according to an aspect of the present invention, having latent image forming means for forming a latent image on an image carrier; developing means for developing the latent image formed on the image carrier by depositing a developing agent on to the latent image; measuring means facing the image carrier, for measuring an amount of the developing agent deposited to the image carrier; and electric field generating means for providing an electric field between the image carrier and the measuring means so as to prevent the developing agent from adhering to the measuring means.

In the image forming apparatus, an electric field is provided between the image carrier and the measuring means by the providing means. Generally, a slight amount of developing agent deposited to the image carrier slightly flies away. However, when the flying agent enters the electric field, it is subjected to the force orientated outside the electric field. For this reason, the flying developing agent is prevented from adhering to the measuring means. Therefore, the measuring means can correctly measure the amount of the developing agent on the image carrier without decreasing the measurement precision of the measuring means, with the result that the image density can be stabilized by controlling the amount of developing agent.

According to another aspect of the present invention its image forming apparatus includes: a measuring means having the measuring section facing an image carrier, for measuring the amount of the developing agent deposited to the image carrier; and a blocking member arranged between the measuring section and image carrier, for preventing the developer from flying away from the image carrier, i.e. from adhering to the measuring section. The blocking member has a transparent resin member free of plasticizer, or a transparent resin member including plasticizer, which is hard to chemically react on styrene and acryl in the developing agent.

When the blocking member is formed of the transparent resin described above, even if the developing agent flying away from the image carrier is attached to the blocking member, it is permanently fixed to the blocking member. The attached developing agent can simply be removed from the blocking member by a brush or the like. Therefore, the measurement precision of the measuring means can be maintained, with the result that the image density can be correctly and stably controlled.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 4 show a color laser printer according to an embodiment of the present invention, in which:

FIG. 1 is a cross-sectional view schematically showing the whole of the color laser printer;

FIG. 2 is a block diagram showing a charger, an exposing device, a developing unit, and the control circuit of the color laser printer;

FIG. 3 is a cross-sectional view schematically showing a toner deposition amount measuring device; and FIG. 4 is a block diagram of the toner deposition amount measuring device shown in FIG. 3;

DETAILED DESCRIPTION OF THE PREFERRED EMBODIMENTS

An embodiment of the present invention will now be described, with reference to the accompanying drawings.

Figure 1:
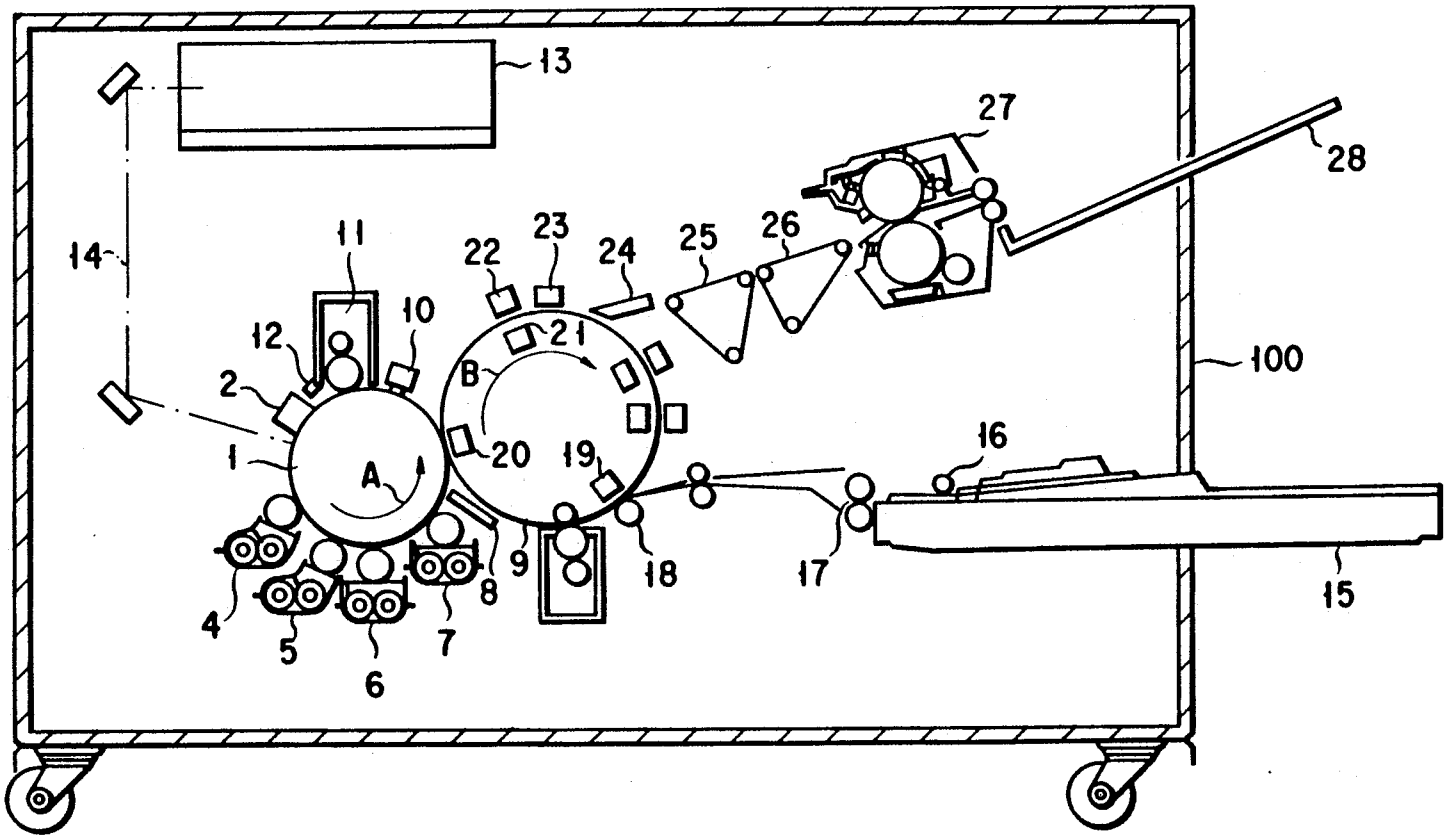

FIG. 1 shows an embodiment wherein an image forming apparatus according to the present invention is applied to a color laser printer. A photoconductive drum 1 serving as an image carrier, which rotates counterclockwise (in the direction of arrow A in FIG. 1), is arranged in substantially the center of a body 100 of the laser printer. A charger 2, first to fourth developing units 4 to 7, a measuring device 8 for measuring an amount of toner deposited to the photoconductive drum 1, a transfer drum 9 serving as a transfer medium supporting member, a precleaning discharger 10, a cleaner 11, and a discharge lamp 12 are arranged in sequence around the photoconductive drum 1.

The photoconductive drum 1 is rotated in the direction of arrow A and its surface is uniformly charged by the charger 2. Between the charger 2 and first developing unit 4, a laser beam 14 is emitted from an optical system 13 serving as an exposing device to the surface of the drum 1, with the result that a static latent image corresponding to image data is formed on the surface of the drum 1.

The first to fourth developing units 4 to 7 are designed to develop the respective static latent images formed on the photoconductive drum 1 to color toner images. For example, the first developing unit 4 develops a magenta image, the second developing unit 5 develops a cyan image, the third developing unit 6 develops a yellow image, and the fourth developing unit 7 develops a black image.

Transfer paper serving as transfer medium is fed from a paper-feeding cassette 15 by means of a paperfeeding roller 16, adjusted by a resist roller 17, and supplied to a predetermined position of the transfer drum 9. Then, the transfer paper is statically adsorbed onto the outer surface of the transfer drum 9 by an adsorption roller 18 and an adsorption charger 19. While being adsorbed onto the transfer drum 9, the transfer paper is carried toward the photoconductive drum 1, as the transfer drum 9 rotates clockwise (in the direction of arrow B in FIG. 1).

The developed toner image formed on the drum 1 is transferred to the transfer paper by a transfer charger 20 at a position where the drums 1 and 9 face each other. When plural-color printing is performed, the developing units are selectively used in one cycle corresponding to one rotation of the transfer drum 9, and a plural-color toner image is multi-transferred.

The transfer paper to which the toner image is transferred, is carried further in accordance with rotation of the transfer drum 9, and electrically discharged by an inner discharger 21, an outer discharger 22, and a separation discharger 23. The transfer paper is then separated from the transfer drum 9 by a separation claw 24. The separated transfer paper is carried to a fixing unit 27 by carrying belts 25 and 26. Toner on the transfer paper heated by the fixing unit 27 is melted, and fixed to the transfer paper directly after the transfer paper is discharged from the fixing unit 27. Then the transfer paper is sent to a discharge tray 28.

Figure 2:
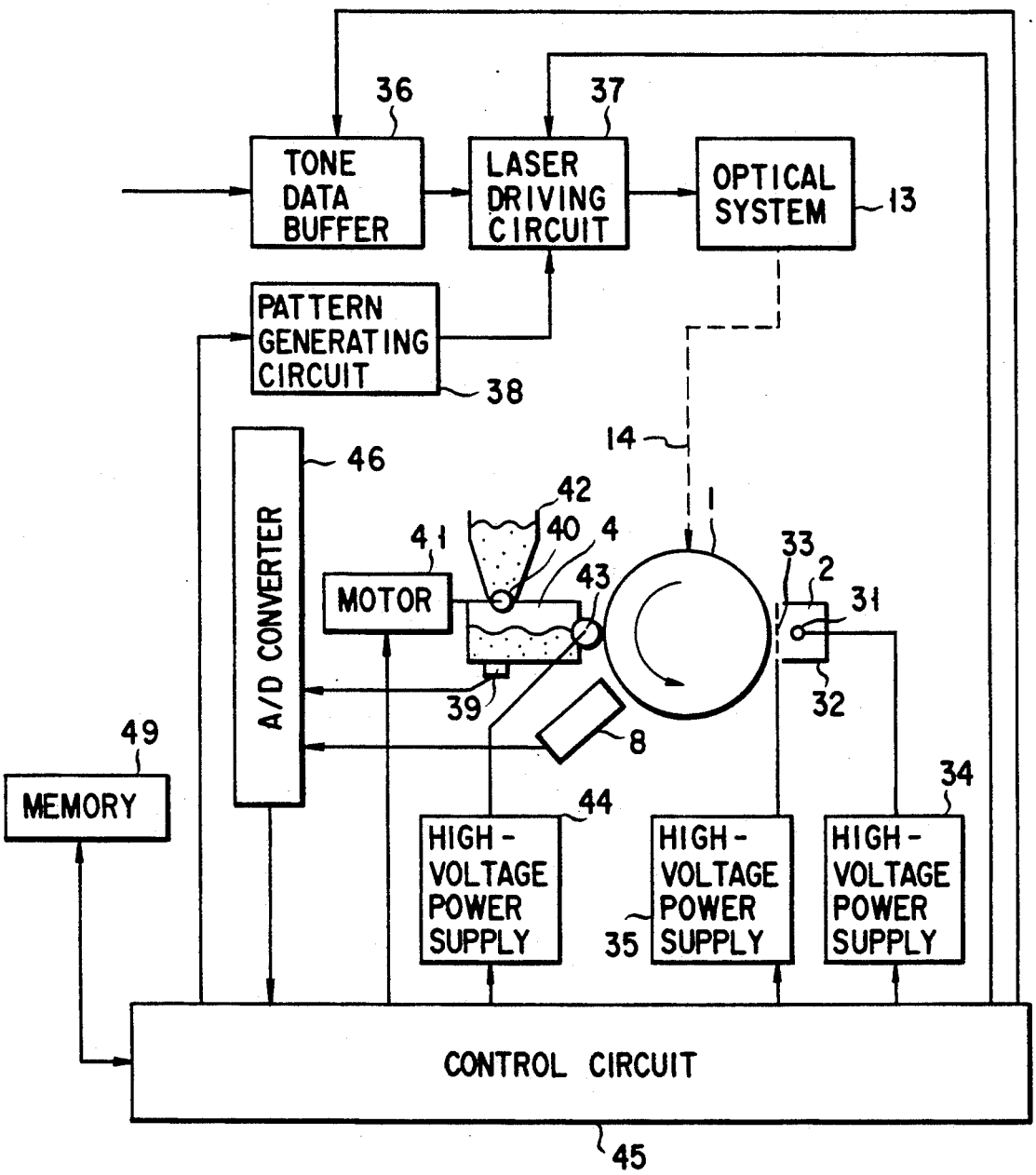

FIG. 2 is a block diagram showing the charger, exposing device, developing unit, and their control circuit of the color laser printer having the structure described above. The structure and operation of the printer will be described in detail with reference to FIG. 2.

The photoconductive drum 1 is rotated counterclockwise. The charger 2 mainly includes a charging wire 31, a conductive case 32, and a grid electrode 33. The charging wire 31 is connected to a corona high-voltage power supply 34, to charge the surface of the photoconductive drum 1 by a corona discharge. The grid electrode 33 is connected to a grid bias high-voltage power supply 35, and the amount of charge on the surface of the drum 1 is determined by the grid bias voltage. The high-voltage power supplies 34 and 35 are connected to a control circuit 45 by which output voltages are controlled.

A static latent image is formed on the surface of the photoconductive drum 1, which is uniformly charged by the charger 2, by exposure of the modulated laser beam 14 emitted from the optical system 13. A tone data buffer 36 stores tone data from an external device or a controller (not shown), corrects the tone characteristic of the printer, and converts the tone data into laser exposure time (pulse width) data. A laser driving circuit 37 modulates laser drive current (emission time) in accordance with the laser beam exposure time data from the tone data buffer 36. A semiconductor laser beam emitting device (not shown) in the optical system 13 is driven by the modulated laser drive current. The semiconductor laser beam emitting device thus emits a laser beam based on the laser beam exposure time data. The laser driving circuit 37 compares an output of a monitoring light receiving element (not shown) in the optical system 13 with a set value, to keep the luminous energy of the laser beam emitted from the emitting device at the set value.

A pattern generating circuit 38 generates tone data of a test pattern proper to the printer and that of a pattern for measuring an amount of toner deposited to the photoconductive drum under the control of the control circuit 45, and transmits the tone data to the laser driving circuit 37.

One of the laser beam exposure time data from the tone data buffer 36 and the tone data of the pattern for measuring the amount of toner from the pattern generating circuit is selected by the control circuit 45, and the selected one is transmitted to the laser driving circuit 37.

The static latent image formed on the photoconductive drum 1 is developed by the developing unit 4. Though the color laser printer according to the embodiment of the present invention has four developing units, as described above, the first developing unit 4 will be described. The developing unit 4 is of a two-component development type and contains developing agent having toner and carriers negatively charged. The ratio of the weight of the developing agent to that of the toner (hereinafter referred to as toner density) is measured by a toner density measuring device 39. A signal output from the measuring device 39 is converted into a digital signal by an A/D converter 46, and the digital signal is supplied to the control circuit 45. The control circuit 45 controls a toner supply motor 41 for driving a toner supply roller 40 in response to the signal output from the measuring device 39. When the toner supply roller 40 is driven, toner is supplied from a toner hopper 42 to the developing unit 4.

A developing roller 43 of the developing unit 4 is formed of a conductive member and connected to a developing bias high-voltage power supply 44. The developing roller 43 rotates while a developing bias voltage being applied thereto, and deposits the toner to a static latent image formed on the photoconductive drum 1. A toner image so formed is transferred to transfer paper supplied by the transfer drum 9. The high-voltage power supply 44 is connected to the control circuit 45, and the developing bias voltage is controlled by the control circuit 45.

When a non-image forming region of the photoconductive drum 1, on which no static latent image is formed, reaches the exposure section, the control circuit 45 converts the laser beam exposure time data, supplied from the tone data buffer 36 to the laser driving circuit 37, into the tone data supplied from the pattern generating circuit 38 to the laser driving circuit. Thus, the non image forming region of the photoconductive drum 1 is exposed, and a tone pattern for measuring the amount of toner deposited to the drum 1 is formed by developing the exposed non-image forming region. When the tone pattern reaches a position opposite to the measuring device 8, the measuring device 8 measures the amount of toner deposited on to the drum 1. The constitution of the measuring device 8 will be described in detail later.

The signals output from the measuring device 8 and toner density measuring device 39 are converted into digital signals by the A/D converter 46, and supplied to the control circuit 45. The control circuit 45 compares the output (measured value) of the toner deposition amount measuring device 8 with a preset reference value of the amount of toner stored in a memory 49, and changes at least one of image forming conditions such as the grid bias voltage of the charger 2, the developing bias voltage of the developing unit 4, the amount of exposure of the optical system 13, the toner density of the developing agent, and the emission time of area tone in accordance with the compared result.

Further, the control circuit 45 sets a target value of the laser driving current, sets a target value of the toner density, controls the supply of toner, corrects the tone data of the printer, and the like.

The amount of toner deposited to the photoconductive drum 1, which is determined by tone data, varies with variations in the image forming conditions due to secular and environmental changes. In order to stabilize the density of an image to be formed, the variation in the amount of toner has to be reduced.

According to an embodiment of the present invention, an amount of toner of a predetermined tone pattern developed on the drum 1 is measured by the toner deposition amount measuring device 8, and a result of the measurement is compared with the reference value stored beforehand in the memory 49. The printer is controlled to always keep the amount of toner constant in accordance with a result of the comparison, thereby stabilizing the image density.

More specifically, according to the color laser printer, the tone data for measuring the amount of toner deposited on to the drum 1, which is supplied from the pattern generating circuit 38, is developed on the photosensitive drum 1 by predetermined grid bias voltage VG and developing bias voltage VD. The toner deposition amount measuring device 8 measures the amount Q of toner deposited to the drum 1 on which a plurality of density patterns is formed based on the tone data. The control circuit 45 compares the amount Q with the predetermined reference value, and infers corrected values $\Delta$ VG and $\Delta$ VD of the grid bias voltage and developing bias voltage from a deviation $\Delta$ Q to obtain the most suitable developing density. The tone data is developed again on the drum 1 by the grid bias voltage VG and developing bias voltage VD corrected by the inference. The measuring device 8 measures the amount Q of toner on the drum 1, and the control circuit 45 compares the measured amount Q with the preset reference value. The above processing is repeated by the control circuit 45 until the deviation $\Delta$ Q between the amount of toner and the reference value falls within an allowable range.

The toner deposition amount with respect to the predetermined tone pattern is always kept constant by the processing of the control circuit and, thus, the image density is stabilized. Though the grid bias voltage and developing bias voltage are used as parameter for controlling the image density, the parameter is not limited to these voltages. For example, a parameter for changing at least one of the image forming conditions such as the amount of exposure of the optical system 13, the toner density of the developing agent, and the emission time of area tone, can be used.

The construction and operation of the toner deposition amount measuring device 8 will be described, with reference to FIGS. 3 and 4.

The measuring device 8 includes a box-like body 83 formed of insulating material and serving as a supporting member. First and second supporting sleeves 50 and 51 formed of insulating material are fixed to the body 83. The body 83 has a bottom wall 83*a* which is opposite to the photoconductive drum 1, with a predetermined interval or distance between them, and a pair of through holes in the bottom wall. The upper ends of the supporting sleeves 50 and 51 are closed, and the lower ends thereof are fitted in the through holes 52 and opened toward the drum 1. A light source 81 such as an LED is arranged in the first supporting sleeve 50 and connected to a light source driving circuit 91. A photoelectric converter 82 is arranged in the second supporting sleeve 51 and connected to a transmission circuit 92. The first and second supporting sleeves 50 and 51 are arranged at a predetermined angle so that light emitted from the light source 81 strikes the surface of the drum 1 through the leftmost of the through holes 52, is reflected by the surface of the drum 1, and enters the photoelectric converter 82 through the other through hole 52.

A conductive cover plate 84 having the same size as that of the bottom wall 83*a*, is fixed onto the underside of the bottom wall 83*a*. A pair of through holes 54 aligned with the through holes 52 are formed in the cover plate 84. The cover plate 84 is connected to the negative of a high-voltage power supply 85 since the charging polarity of the toner is negative. In other words, the cover plate 84 is connected to the high-voltage power supply 85 for generating a voltage whose polarity is the same as the charging polarity of the toner. Since the light source 81 and photoelectric converter 82 are supported by the insulating body 83 and supporting sleeves 50 and 51, neither of them is influenced by the high voltage applied to the cover plate 84.

Light is emitted from the light source 81 to the surface of the photoconductive drum 1 through an optical path 86, and reflected by the surface of the drum 1 or toner deposited to the surface. The reflected light reaches the photoelectric converter 82 through the optical path 86. The photoelectric converter 82 converts the reflected light into current in accordance with the amount of the reflected light, and converts the current into a voltage. The voltage is then transmitted to the A/D converter by the transmission circuit 92 and converted into a digital signal. The digital signal is supplied to the control circuits 45. The light source driving circuit 91 for driving the light source 81 is turned on or off by the control circuit 45, or it is controlled in response to a signal for adjusting the amount of driving current supplied to the light source 81.

With a printer having the above-described construction, the amount of toner deposited on to the photoconductive drum 1 can be measured, and the image density can be controlled based on the measured amount. The conductive member 84 is attached to the surface of the toner deposition amount measuring device 8 opposite to the drum 1, that is, the bottom wall 83*a* of the body 83. A voltage having the same polarity (negative in this embodiment) as the charging polarity of the toner, is applied to the conductive member 84 from the high-voltage power supply 85, and an electric field is generated between the conductive member 84 and the surface of the drum 1. The toner deposited to the drum 1 is slightly dispersed. Since, however, the toner is negatively charged, when the dispersed toner enters the electric field, it is subjected to the force applied outside the electric field, that is, the force applied in the direction away from the lower open ends of the first and second sleeves. For this reason, the dispersed toner does not enter the measuring device 8 through the lower open ends of the first and second sleeves, and thus can be prevented from being adhered to the light source 81 and photoelectric converter 82. Therefore, the measurement precision of the toner deposition amount measuring device 8 is not influenced by the dispersed toner, so that the device 8 can correctly measure the toner deposition amount. Furthermore, the result obtained by the measuring device 8 is compared with the predetermined reference value, and at least one of the image forming conditions such as the amount of charge on the photosensitive drum 1, the developing bias voltage applied to the developing roller 43, the amount of exposure of the optical system 13, and the toner density of the developing agent, is changed based on the result of the comparison, thereby controlling the image density. Therefore, the image density, can always be kept constant and variations in image density due to secular changes and environmental changes can be properly controlled in a cycle shorter than that needed for maintenance. The stability of the image density can be increased, and the cost of the maintenance (personnel expenses, equipment) can be lowered.

Figure 5:
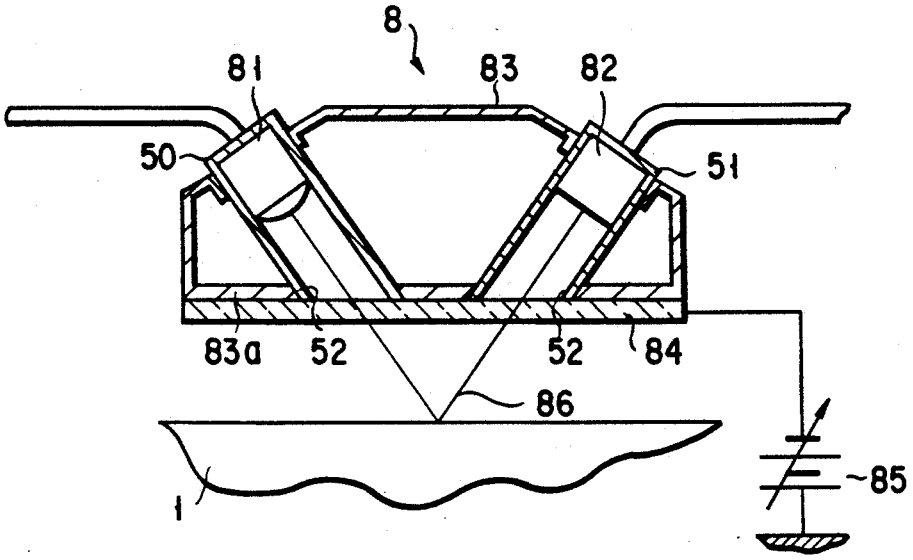
FIG. 5 is a cross-sectional view schematically showing a first modification to the toner deposition amount measuring device.

FIG. 5 shows a toner deposition amount measuring device 8 according to a first modification of the invention. According to the first modification, a cover plate 84 is formed of conductive transparent material, and the through holes 54 in the above embodiment are omitted. Through holes 52 of supporting sleeves 50 and 51 are closed by the cover plate 84. Since the device 8 shown in FIG. 5 is the same as that shown in FIG. 3, except for the above, the descriptions of the components denoted by the same reference numerals as those in FIG. 3 are omitted.

Figure 3:
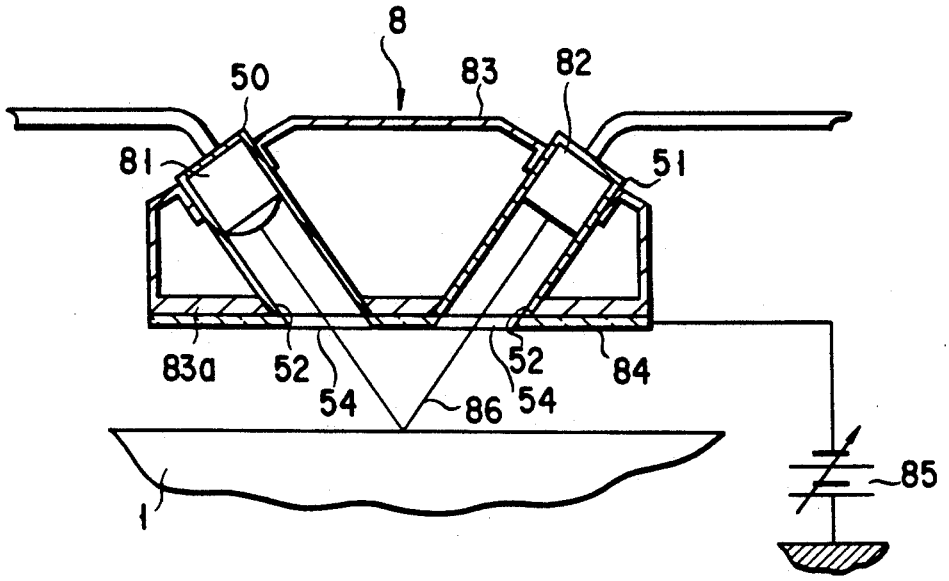
Figure 4:
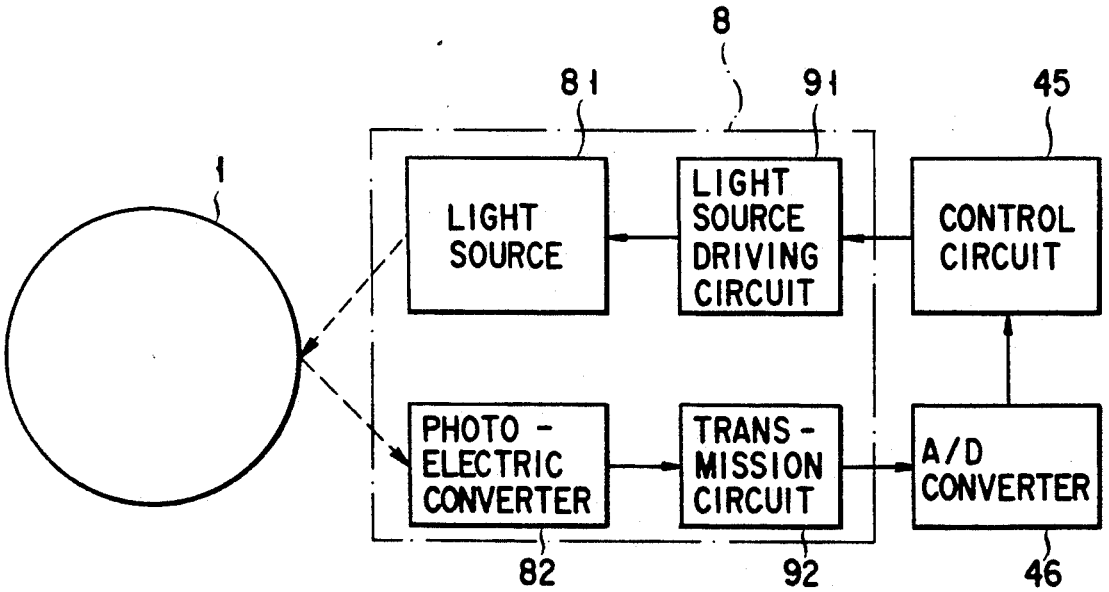

The toner deposition amount measuring device 8 shown in FIG. 5 has the same advantage as that of the device shown in FIG. 3. Additionally, since the lower ends of the first and second sleeves 50 and 51 are closed by the cover plate 84, dispersed toner can completely be prevented from entering the sleeves and can be more reliably prevented from adhering to the light source 81 and photoelectric converter 82.

Figure 6:
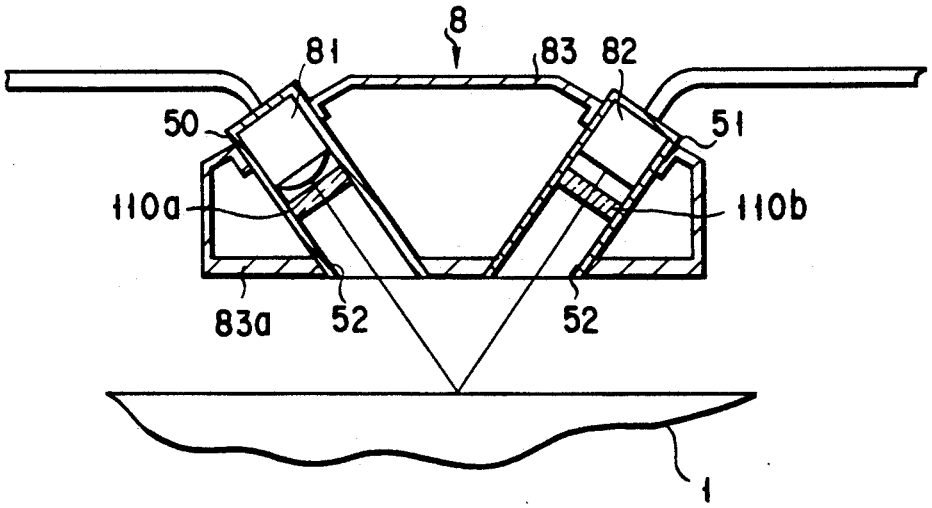
FIG. 6 is a cross-sectional view schematically showing a second modification to the toner deposition amount measuring device.

FIG. 6 shows a toner deposition amount measuring device 8 according to a second modification of the invention. With this second modification, the measuring device 8 does not include the conductive cover plate 84 or the high-voltage power supply 85 connected thereto, but blocking members 110*a* and 110*b* arranged in the first and second sleeves 50 and 51. Since the device 8 shown in FIG. 6 is the same as that shown in FIG. 3, except for the above, the descriptions of the components denoted by the same reference numerals as those in FIG. 3 are omitted.

The blocking member 110*a* is fixed in the first sleeve 50 so as to close the sleeve and separates the light source 81 and through hole 52 from each other. The blocking member 110*b* is fixed in the second sleeve 51 to close the sleeve and separates the photoelectric converter 82 and through hole 52 from each other.

These blocking members 110*a* and 110*b* are formed of a transparent material to which no toner is fixed. In the second modification, the "fixation" means that toner is adhered to the blocking members by heat, friction, chemical reaction, or the like, and cannot be easily removed therefrom. As an example of the chemical reaction, there is a case where plasticizer included in the blocking members is softened by chemical reaction to styrene or acryl in the toner and the toner is fixed to the blocking members. In the second modification, material including no plasticizer or material including plasticizer which is hard to react on styrene and acryl, is used.

For example, fluoroplastics, polyacryl resin, vinyl resin, or the like, which includes no plasticizer, is used as the material for the blocking members 110*a* and 110*b*. Polytetrafluoroethylene (PTFE), polychlorotrifluoroethylene (PCTFE), tetrafluoroethylene-hexafluoride fluorinated ethylene propylene (FEP), polyvinylidene fluoride (PVDF) are preferred as the fluoroplastics. Furthermore, high polymer plasticizers, such as polyester, can be used as the plasticizer which is hard to react on styrene and acryl.

When the blocking members 110*a* and 110*b* are constituted of the above-described material, even if toner flying away from the photoconductive drum 1 is adhered to the blocking members, it is never fixed thereto. In this case, the "adhesion" means that the toner contacts the blocking members in such a manner that the toner can easily be removed from the blocking members. Thus, the toner can always be easily removed from the blocking member. If the toner adhering to the blocking members is removed, the precision of the measuring device 8 can be maintained, and the image density correctly and stably controlled.

Figure 7:
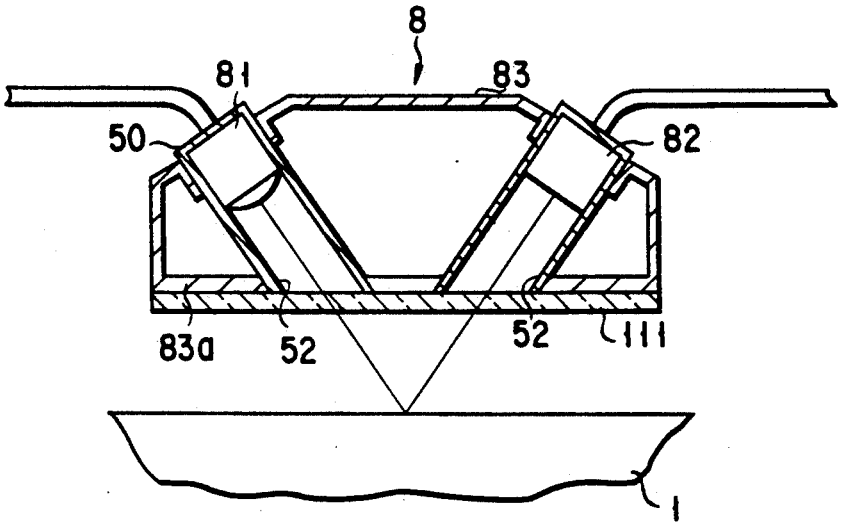
FIG. 7 is a cross-sectional view schematically showing a third modification to the toner deposition amount measuring device.

FIG. 7 shows a toner deposition amount measuring device 8 according to a third modification. According to the third modification, the whole underside of a body 83 is covered with a transparent blocking plate 111 which is formed of the same material as described above, e.g., a fluoroplastic free of plasticizer. This third modification has the same advantage as that of the second modification.

Figure 8:
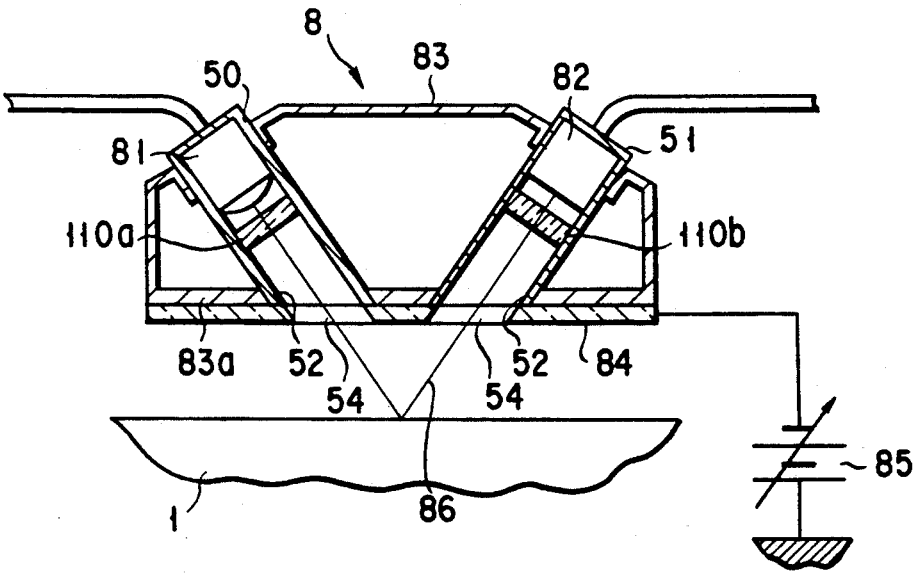
FIG. 8 is a cross-sectional view schematically showing a fourth modification to the toner deposition amount measuring device.

FIG. 8 shows a toner deposition mount measuring device 8 according to a fourth modification of the invention. The measuring device 8 is formed by combining the measuring device of the above-mentioned embodiment shown in FIG. 3 and that of the second modification. More specifically, a conductive cover plate 84 is fixed to the outer surface of the bottom wall 83*a* of the measuring device 8 and connected to a high-voltage power supply 85. First and second sleeves 50 and 51 are blocked with transparent blocking members 110*a* and 110*b* which are formed of the above-mentioned material, respectively.

The measuring devices according to the third and fourth modifications allow image density to be correctly and stably controlled.

The present invention is not limited to the above embodiment, but various changes and modifications can be made without departing from the scope and spirit of the invention.

For example, in the above embodiment and modifications, the toner deposition amount measuring device comprises the light source and the optical sensor having the photoelectric converter. However, the optical sensor can be replaced with a non-contact type sensor such as an ultrasonic sensor and a potential difference sensor.

What is claimed is:

1. An image forming apparatus comprising:

means for forming a latent image on an image carrier;

developing means for developing the latent image formed on the image carrier by adhering a developing agent to the image carrier, the developing agent charged to a predetermined polarity;

measuring means for measuring the amount of the developing agent deposited onto the image carrier, the measuring means having means for outputting a detection signal to the image carrier, means for receiving the detection signal reflected by the image carrier, and a support member formed of insulating material for supporting the outputting and receiving means; and means for preventing a developing agent flying away from the image carrier from being attached to the measuring means, the preventing means including a transparent conductive member fixed to the support member and located between the image carrier and the outputting and receiving means, and means for applying a voltage, whose polarity is the same as the polarity of the developing agent, to the conductive member, so as to generate an electric field between the image carrier and the conductive member.

2. An apparatus according to claim 1, which further comprises means for storing a predetermined reference value, and means for controlling at least one of operations of said latent image forming means and said developing means based on the amount of the developing agent deposited onto the image carrier measured by the measuring means and the predetermined reference value.

3. An apparatus according to claim 1, wherein said developing means includes means for charging the developing agent to have a predetermined polarity which is the same as the polarity of the developing agent.

4. An image forming apparatus comprising;

means for forming a latent image on an image carrier;

developing means for developing the latent image formed on the image carrier by adhering a developing agent, the developing agent charged to have a predetermined polarity;

means for transferring a developed image to a recording medium;

measuring means arranged between the developing means and the transferring means, for measuring an amount of the developing agent deposited onto the image carrier, the measuring means having means for outputting a detection signal to the image carrier, means for receiving the detection signal reflected by the image carrier, and a support member formed of insulating material for supporting the outputting and receiving means; and means for preventing a developing agent flying away from the image carrier from being attached to the measuring means, the preventing means including a transparent conductive member fixed to the support member and located between the image carrier and the outputting and receiving means, and means for applying a voltage, whose polarity is the same as the polarity of the developing agent, to the conductive member so as to generate an electric field between the image carrier and the conductive member and thereby repel the developing agent.

* * * * *

UNITED STATES PATENT AND TRADEMARK OFFICE

CERTIFICATE OF CORRECTION

PATENT NO. : 5,270,784

DATED : Dec. 14, 1993

INVENTOR(S) : Rintaro NAKANE and Jiro EGAWA

It is certified that error appears in the above-indentified patent and that said Letters Patent is hereby corrected as shown below:

On the title page: Item [22]

Column 1, Line [22], "Aug. 29, 1992" should read --Aug. 26, 1992--.

Signed and Sealed this

Sixteenth Day of August, 1994

Bruce Lehman

*Attest:*

BRUCE LEHMAN

*Attesting Officer*

*Commissioner of Patents and Trademarks*